US005924184A

United States Patent [19]

Donini et al.

[11] Patent Number: 5,924,184

[45] Date of Patent: Jul. 20, 1999

[54] METHOD FOR THE CONTINUOUS ROLLING OF PLATE AND/OR STRIP AND THE RELATIVE CONTINUOUS ROLLING LINE

[75] Inventors: Estore Donini, Vimercate; Fausto Drigani, Zugliano Pozzuolo Del Friuli, both of Italy

[73] Assignee: Danieli & C. Officine Meccaniche SpA, Buttrio, Italy

[21] Appl. No.: 08/818,429

[22] Filed: Mar. 17, 1997

[30] Foreign Application Priority Data

Mar. 15, 1996 [IT] Italy ..... UD96 A 000033

[51] Int. Cl.[6] ..... B22D 11/00

[52] U.S. Cl. ..... 29/527.7; 29/526.6; 29/33 B; 29/33 C

[58] Field of Search ..... 29/527.7, 526.6, 29/33 B, 33 C

[56] References Cited

U.S. PATENT DOCUMENTS

| | | | |
|---|---|---|---|
| 2,214,618 | 9/1940 | Kenyon | 80/31.1 |
| 4,630,352 | 12/1986 | Ginzburg et al. | 29/527.7 |
| 4,711,114 | 12/1987 | Rohde et al. | 72/234 |
| 4,793,168 | 12/1988 | Kimura | 29/527.7 X |
| 4,829,656 | 5/1989 | Rohde | 29/527.7 |
| 4,942,656 | 7/1990 | Benedetti et al. | 29/527.7 X |
| 4,976,024 | 12/1990 | Kimura | 29/33 C X |
| 5,075,953 | 12/1991 | Braud | 29/33 C X |
| 5,121,873 | 6/1992 | Sekiya et al. | 29/527.7 X |
| 5,235,840 | 8/1993 | Blazevic | 72/201 |
| 5,414,923 | 5/1995 | Thomas et al. | 29/33 C X |
| 5,461,770 | 10/1995 | Kimur et al. | 29/33 C X |
| 5,490,315 | 2/1996 | Kostopolos et al. | 29/33 B X |
| 5,528,816 | 6/1996 | Donini et al. | 29/527.7 |
| 5,542,162 | 8/1996 | Coassin et al. | 29/33 C |
| 5,689,991 | 11/1997 | Kircher | 29/527.7 X |

FOREIGN PATENT DOCUMENTS

| | | |
|---|---|---|
| 460655 | 12/1991 | European Pat. Off. . |
| 0625383A1 | 11/1994 | European Pat. Off. . |
| 0662358A1 | 7/1995 | European Pat. Off. . |
| 0674952A1 | 10/1995 | European Pat. Off. . |
| 55-112104 | 8/1980 | Japan . |
| 56-114521 | 9/1981 | Japan . |
| 62-157715 | 7/1987 | Japan . |
| 63-286203 | 11/1988 | Japan . |

OTHER PUBLICATIONS

Ayed et al, "Compte Rendu de la 2e Conference europeenne sur la Coulee Continue", Jun. 19 –23, 1994, Dusseldorf.

Stahl & Eisen, vol. 108 108, No. 3 Feb. 8, 1988 pp. 99–109, Flemming et al "Walzen Von Stranffegossenen Vorbandern . . ".

(List continued on next page.)

*Primary Examiner*—Joseph J. Hail, III
*Assistant Examiner*—William Hong
*Attorney, Agent, or Firm*—Antonelli, Terry, Stout & Kraus, LLP

[57] ABSTRACT

Method and relative line for the continuous rolling of plate and/or strip, starting from at least two lines for the continuous casting of thin slabs (11) of between 60 and 120 mm thick, the pre-slabs being continuously cast within a limited range of thicknesses of between 70 and 140 mm and at a speed of up to 6+7 meters per minute, the pre-slabs then being transformed into slabs by a process of soft-reduction (112) which reduces the thickness of the individual pre-slab by 5 to 40 mm so as to obtain a range of slabs with a defined thickness using the the same crystallizer, and the rolled product (111) now in a strip leaving the roughing train (17) being sent to the finishing train (20), the leading end of the strip as it arrives being connected to the trailing end of the strip being rolled so as to form a substantially continuous product fed to the finishing train (20), the connection being made by a welding machine (24) positioned upstream of the finishing train (20), the end-of-rolling temperature being between 840 and 880° C. and the product of the speed of the strip at the outlet of the finishing train, multiplied by the thickness of the strip being between 800 and 1100 mm.m/min.

38 Claims, 2 Drawing Sheets

OTHER PUBLICATIONS

Patents Abstacts of Japan vol. 16 No. 346 (M–1286) Jul. 27, 1992 & JP–A–04–105701 (Hitachi) Apr. 7, 1992 abstract Figures 3–5.

Patents Abstracts of Japan vol. 16 No. 380 (M–1295) Aug. 14, 1992 & JP–A–04 123804 (Hitachi) Apr. 23, 1992, abstract, Figs. 1–3.

Patent Abstracts of Japan vol. 10 No. 122 (M–476) May 7, 1986 & JP–A–60–250811 (Sumitomo) Dec. 11, 1985 Abstract.

Patent Abstracts of Japan vol. 16 No. 87 (M–1217) 3 Mar. 1992 & JP–A–03 268882 (Hitachi) 29 Nov. 1991abstract; figures 1, 2, 6.

Patents Abstracts of Japan, vol. 10, No. 295 (M–523), Oct. 7, 1986 & JP–A–61 108408 (Sumitomo) May 27, 1986 Abstract, Figures.

METHOD FOR THE CONTINUOUS ROLLING OF PLATE AND/OR STRIP AND THE RELATIVE CONTINUOUS ROLLING LINE

BACKGROUND OF THE INVENTION

This invention concerns a method for the continuous rolling of plate and/or strip, and the relative continuous rolling line.

To be more exact, the invention arranges to produce plate and/or strip, starting from at least two continuous casting lines or else from one continuous casting machine with two lines for the production of thin and medium-sized slabs of steel, where the slab as it enters the roughing train is between 60 and 120 mm thick, and the lines are positioned side by side or cooperate with each other and are associated with the same roughing train and the same finishing rolling train.

The rolling line according to the invention is pre-arranged to process continuously, that is to say, to provide a substantially continuous feed of slab to the finishing train throughout the whole casting cycle of all the casting lines working in cooperation with the finishing train.

The thin and medium-sized slabs to which the invention is applied have a thickness between 60 mm and 120 mm, advantageously between 70 and 90 mm when they enter the roughing train. In other words, the invention arranges to obtain, at the outlet of the crystallizer, pre-slabs with a substantially uniform thickness. The invention also teaches to obtain slabs with a thickness coherent with the requirements of the rolling line, by means of a process of soft-reduction applied to the pre-slab immediately after the crystallizer.

The rolling line according to the invention is suitable to produce plate and/or strip having a minimum finished thickness of about 0.8 mm to 1.5 mm.

Stahl und Eisen, Vol. 108, n°. 3 pages 99–109 describes lines for the rolling of plate and/or strip which include one or more continuous casting machines for slabs of a fixed thickness of 50 mm that tend-the same one finishing train. This fact alone makes the system described therein extremely rigid.

This finishing train may be positioned on the same axis as one of the casting lines or may be in an intermediate position between the two casting lines.

Such lines normally include transfer systems, which consist of heating furnace systems or at least of temperature-maintaining furnace systems and which transfer the slab from a casting line or lines which are located in a position offset from the finishing train.

In such lines, the furnaces are used to heat the slabs from the end-of-casting temperature to the optimum temperature for rolling.

Another important function of such furnaces is to create a buffer stock of sufficient size to keep the continuous casting working even during interruptions in the rolling process, for example when rolls have to be changed.

This lay-out entails interruptions in the feed to the finishing train between the end of the processing of one slab and the beginning of the processing of the next slab.

The interruptions are caused by the fact that, with current casting speeds, in the event of two casting machines or one casting machine with two lines, it is not possible to obtain a sufficient production when the slab is 50 mm thick.

These interruptions lead to a discontinuous working of the rolling train with transient moments of intake of a slab, these moments causing disturbances of the system and entailing unfavourable effects on the thickness, width, profile and planar condition of the strip.

Furthermore, these interruptions involve the risk of failure to feed the rolled product into the rolling mill and into the coiling reel and therefore of jamming with a resulting loss of production and damage and wear to the rolling rolls.

In other words the rolling mill works constantly in a transient condition with the above unfavourable results.

In fact, when the thin slab has a starting thickness of 50 mm, in order to obtain a 2.5 mm strip the speed of the finishing train must be 6.4 meters per second, which corresponds to a value of steel flow per unit of strip width of 960, the product of the speed in m/min multiplied by the thickness in mm.

The value of between 800 mn.m/min and 1100 mn.m/min must be respected, and cannot be reduced, if the correct end-of-rolling temperature (between 840 and 880° C.) is to be obtained. When the slab is 50 mm thick, two casting lines should cast at the speed of 9 meters per minute, which for the moment is an unattainable objective, as the maximum casting speed which can be achieved at present is around 6 meters per minute for that thickness of slab.

Therefore, these interruptions of the feed prevent the best exploitation of the potential of the finishing train, which is forced to work in a discontinuous manner and thus restricts the quality and overall output of the plant, particularly when slender thicknesses such as those less than 1.2 mm are being produced.

Indeed, it is a serious problem in the rolling of thin strip, as the rolling speeds cannot increase beyond a certain limit since they are restricted by the problems of the feed of the leading end of the strip onto the roller conveyor at the outlet from the finishing train; in fact, as the leading end of the thin strip is fed onto the roller conveyor as it leaves the finishing train, it tends to be raised on the roller conveyor and to bounce backwards.

SUMMARY OF THE INVENTION

The present applicants have designed, tested and embodied this invention to overcome these shortcomings of the state of the art and to achieve further advantages.

The purpose of this invention is to achieve a rolling method with a continuous feed of the finishing train, starting from slabs with a thickness of between 60 and 120 mm.

According to the invention, the slab is obtained by subjecting the pre-slab, as it leaves the crystallizer, to a process of controlled soft-reduction applied immediately after the crystallizer. The invention tends to give maximum flexibility to the plant and makes possible the elimination of the interruptions of feed between the end of the processing of a slab coming from one casting line and the beginning of the processing of a slab coming from a different casting line. At the same time it is possible, with this invention, to cast at a casting speed which can be achieved today, coherent with present-day technology, that is to say, at about 6–7 meters per minute in the case of the thicknesses cited.

With speeds such as these, two casting lines with a soft-reduction assembly which are producing slabs with a thickness of between 70 and 90 mm, can reach values of specific delivery comparable to those of the finishing rolling mill, that is to say, 800–1100, the product of the speed in m/min multiplied by the thickness in mm.

Such a continuous feed enables the finishing train to work substantially always at a normal running speed, always working within the range of the correct end-of-rolling temperature, that is to say, between 840 and 880° C.

This makes it possible to eliminate the problems linked to the continuous transient moments of intake of the slab, thus reducing the risk of jamming and eliminating the problems of feed and of rising of the leading end of the strip on the roller conveyor at the outlet of the finishing train.

This substantially continuous feed makes possible an increase of the rolling speed and therefore of the output of the plant and also the production of a better finished product in terms of thickness, width and superficial and inner quality and also enables the average working life of the processing rolls to be increased, by reducing wear on the rolls with the same length of strip rolled.

Thus, in order to obtain a final strip thickness of 2.5 mm, the invention teaches to start from a slab with a thickness of between 80–100 mm, advantageously 90 mm, so that the speed of the slab as it leaves the finishing train, multiplied by the thickness of the strip, remains within the value of 800–1100, the product of the speed in m/min multiplied by the thickness in mm, and thus ensures the correct end-of-rolling temperature (840÷880° C.) on the one hand, and a casting speed of about 6 meters per minute on the other.

According to the invention, the pre-slabs arriving from the respective continuous casting lines are subjected to a process of controlled soft-reduction in order to obtain the desired thickness of the slab; these slabs are then forwarded to the roughing step, in which they undergo the appropriate reduction of thickness.

By using this process of soft-reduction, as disclosed in U.S. Pat. No. 5,488,987, the contents of which are incorporated herein by reference, it is possible to obtain from the pre-slab leaving the crystallizer the slab of the desired thickness which has already been subjected to a controlled process of reduction and pressing.

With this system the flexibility of the plant is considerably increased, as it is possible to obtain slabs within quite a wide range of thicknesses, even of about 40 mm, starting from a pre-slab of defined thickness.

For example, a crystallizer which produces pre-slabs with a thickness of 100 mm, when associated with a soft-reduction assembly, is able to provide slabs with a thickness of between 95 and 60 mm. According to the invention, advantageously the thickness of the slabs which can be obtained with a crystallizer producing pre-slabs with a thickness of 100 mm will be of between 90 and 70 mm.

In other words, in order to obtain the desired range of slab thicknesses of between 60 and 120 mm, it is sufficient to have two crystallizers only, with the thickness of the pre-slab defined.

According to one embodiment of the invention, a crystalliser with a pre-slab thickness of 100 mm and a crystalliser with a pre-slab thickness of 130 mm are enough to cover the whole range of slab thicknesses from 60 to 120 mm.

According to a variant, three crystallizers, which produce pre-slabs with a thickness of 90 mm, 110 mm and 130 mm respectively (or similar values), are able to cover the entire range of thicknesses from 60 to 80 mm, from 80 to 100 mm, and from 100 to 120 mm respectively.

It is obvious that, according to the invention, it is also possible to use crystallizers which cover different ranges of thicknesses, typical of the final characteristics of the product leaving the rolling mill.

The connection between the two casting lines is achieved with a transfer furnace which carries the slabs in line with the rolling mill.

The connection is decidedly simple and avoids those problems which are caused in plants which include for each casting line a pre-rolling step with winding into a coil.

In fact, in such plants, if the coils for any reason remain stationary in a furnace, the result will be:

- high level of oxidation. The thickness of the bar, or strip, wound onto the coils can vary from 25 to 40 mm. If the rolling mill stops downstream, the damage caused by oxidation is very high, as the oxidation takes place on a product which has already been roughed.
  - In this case the descaling assembly at the beginning of the finishing train may not be able to completely eliminate the scale which has been produced in the furnace during the interruption in the finishing train.
  - Moreover, the oxidized surface is practically doubled in the case of a furnace for coils compared with a tunnel furnace for slabs.
- deformation of the coil. The machine which winds the bar into coils cannot generate a compact coil, and therefore there is a high probability that, with time, the coil itself will lose tension.

Compared with the solution of roughing the slab coaxially with every casting line, according to the invention the roughing step is carried out by one single roughing train common to the two or more casting lines, with a considerable saving in space, investment costs and management costs.

At the outlet of the roughing train, which normally includes from one to three rolling mill stands, the strip thus produced is wound to form a coil.

According to a variant, before forming the coil the strips are subjected to descaling.

These coils are then forwarded to a transfer system, which according to a variant includes heating means or temperature-maintaining means, in which the coils are correctly positioned on the same axis as the finishing train.

According to the invention a welding unit is included upstream of the finishing train and is suitable to flash weld, using laser technique or induction, the trailing end of the previous coil now being rolled to the leading end of the new coil to be rolled, thus achieving continuity of the product to be rolled.

This welding machine may be of a type which accompanies the product and is therefore able to perform this welding operation during the travel of the product.

According to a variant this welding machine is of a static type and performs the weld in a halted position or with the product moving at a low speed.

Where the welding is performed in a halted position, a unit to form a horizontal or vertical loop or loops is included downstream of the welding machine and acts as a buffer stock and continues to feed the finishing train when the trailing end of the previous coil now being rolled is halted or slowed down to enable the weld to be made.

According to the invention shearing means are included immediately upstream of the welding machine and, according to a variant, cooperate with descaling means and have the function of cropping the trailing end of the previous coil now being rolled and also a segment of the leading end of the new coil, thus making flat, parallel and free of scale the facing surfaces to be welded and pre-arranging those surfaces for the successive welding step.

According to a variant these shearing means, the descaling unit and the welding machine are arranged within a substantially closed chamber, in which a saturated atmosphere of neutral gas, argon for instance, is maintained so as to prevent the oxidation of the cropped ends of the strip.

Moreover, the performance of the cropping immediately before the welding reduces to a minimum the time in which the sheared ends of the slabs to be welded are exposed to the danger of oxidation, thus improving the flash welding by means of laser technique or induction.

According to a variant the shearing means are positioned immediately downstream of the roughing train, and descaling and/or oxidation-prevention means are included just the same upstream of the welding unit.

A system for alignment of the coil is also included and has the task of aligning suitably the leading end of the new coil with the trailing end of the rough-formed product now being rolled.

According to the invention, in the event that the plant also rolls thin slabs (0.8–1.5 mm), one or all the roughing stands of the rolling mill are equipped with a system to control the deformation of the processing rolls; this serves to constantly control the geometry of the section of the transfer bar as it enters the finishing stand, so as to obtain a transverse section of the strip both with the long faces parallel and flat, and also with the appropriate rounded contour coherent with the subsequent cold rolling.

It is also a feature of the invention to control the final rolling temperature, regardless of the thickness of the final product.

Since the speed at which the strip enters the rolling mill must be constant, for the same width of strip, the invention includes, between the finishing stands, a controlled cooling system associated with a system to control the temperature of the strip so that this final temperature will be between 840 and 880° C.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENT

The reference number 10 in the attached figures denotes generally the line for the continuous rolling of plate and/or strip with two casting lines according to the invention.

The two casting lines may be separate lines or may include one single casting machine with two lines. According to the invention, the casting thickness of the pre-slabs is between 70 and 140 mm; they are transformed into slabs by means of a process of soft-reduction which is obtained by acting with the assembly 112 as disclosed in U.S. Pat. No. 5,488,987, the contents of which are incorporated herein by reference. The process of soft-reduction reduces the thickness of the pre-slab by a value of between 5 and 40 mm, normally 10–30 mm, obtaining slabs of a thickness in the resulting range. Thus, with a pre-slab thickness of 100 mm, it will normally be possible to obtain slabs with a thickness of between 70 and 90 mm, but this can vary however, according to requirements.

The inclusion of a soft-reduction assembly 112 makes it possible to manage, with a single crystallizer, a wide range of slab thicknesses (we have seen that with a 100 mm crystallizer it is possible to obtain slabs with very different thicknesses, including slabs with a thickness of between 70 and 90 mm) and therefore to correlate in the best possible manner the thickness of the slab with that of the final product.

In fact, when the slab is 70 mm thick, it is possible to optimize the cycle, according to the invention, with a casting speed of about 6 meters per minute in order to obtain a final thickness of 0.8 mm, while with a thickness of 90 mm it is possible to maintain the same casting speed and optimize the plant to obtain a final thickness of 12.5 mm.

Figure 1:
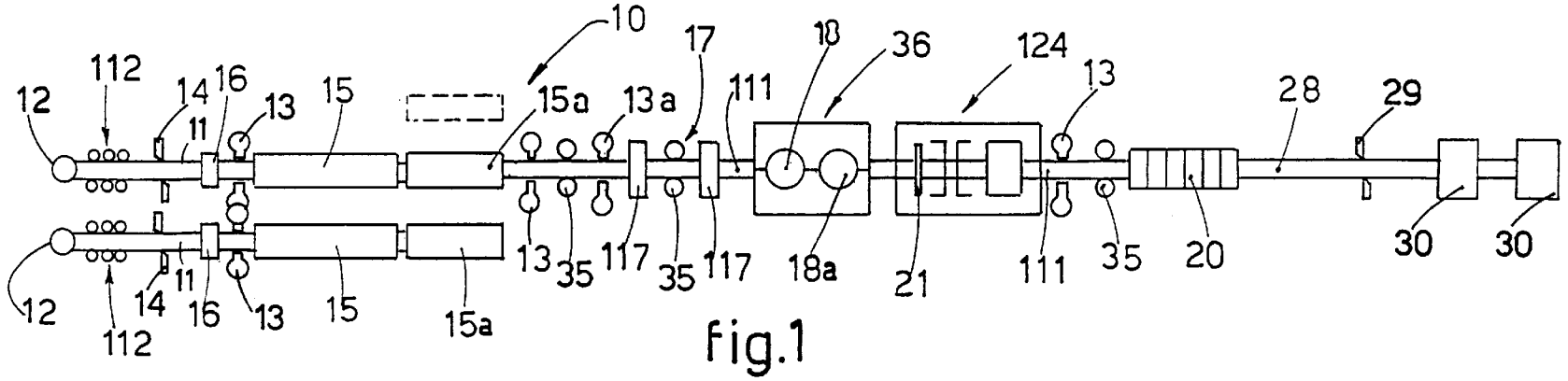
FIG. 1 is a diagram of a form of embodiment of a continuous rolling line according to the invention.

In the embodiment of FIG. 1, on each of the two casting lines a slab 11 coming from a relative soft-reduction assembly 112 is sheared to size by the shears 14 and is then sent to an induction furnace 16 and then subjected to descaling of its surface by first descaling means 13 and is then fed to a first furnace 15.

According to a variant, the descaling means 13 are positioned upstream of the shears 14.

According to another variant, the induction furnace 16 is not included.

Figure 2:
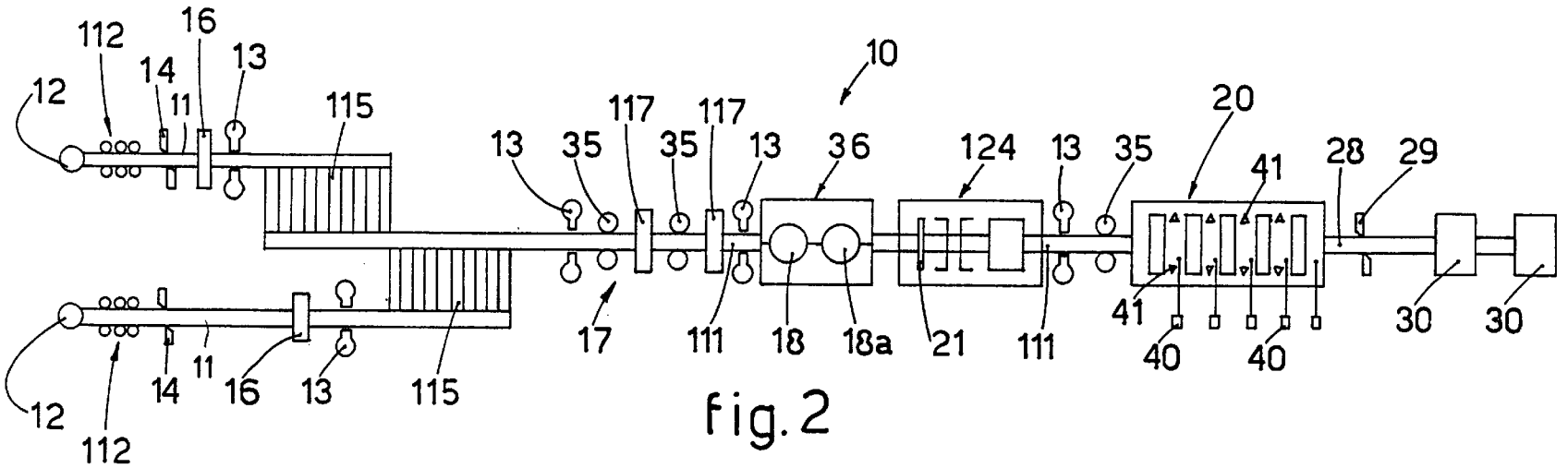
FIG. 2 shows another form of embodiment of a continuous rolling line according to the invention.

In the lay-out of FIG. 2 the transfer furnaces 115 include an inlet roller conveyor and means to transfer the slabs sideways. In this way, it is possible to increase the buffer stock of slabs and make the connection between the continuous casting lines and the rolling mill even more flexible.

The slabs are discharged from the furnaces 115, which can also be facing each other, onto the way which takes them to the rolling mill alternatively or according to the desired sequence.

The furnaces 15 and 16 have the task of heating the slabs 11 to the required temperature so as to be able to feed a roughing train 17 located at the outlet of the furnaces 15 and 16.

According to a variant, the slabs are subjected to descaling by a descaling assembly 13 before they enter the roughing train 17.

The slabs 11, as they come from the soft-reduction assembly 112, leave the roughing train 17 in the form of strip with a thickness of between 15 mm and 40 mm approximately, which depends on the thickness of the final product and on the rolling cycle to which the product is subjected.

For example, according to the invention, for a final thickness of 0.8 mm we will have a strip thickness at the outlet of the roughing train 17 of about 25 mm (±¾ mm) while, for a final sheet of 16 mm, the strip will be about 40 mm (±⅘ mm) thick.

The roughing train 17 may include a number of rolling mill stands between one and four but preferably two or three.

The embodiment of FIG. 2 includes two roughing stands.

The roughing train 17 is shared by the two casting lines; in this case, the furnace 15 as shown in FIG. 1 is of a modular type and has its last module 15*a* movable sideways so as to transfer the slabs 11 from the line offset from the roughing train 17 to a position on the same axis as the roughing train 17.

The roughing train 17 includes at least a stand which is equipped with means to control the planar condition of the strip as it emerges, and means to condition the preload of the roughing rolls.

According to a variant the roughing train 17 cooperates upstream with an assembly 35 performing rolling of the edges of the slabs 11; this assembly 35 may be followed according to a variant by a descaling unit 13*a* operating with a progressively increasing volume of water.

According to another variant an assembly 35 performing rolling of the edges of the slabs 11 is included upstream of each rolling mill stand 117 of the roughing train 17.

The rolled product 111 leaving the roughing train 17 is then wound in coils in a winding/unwinding assembly 36.

When the coil 18*a* already being rolled is about to be finished, a connection assembly or welding assembly 124 intervenes; a shearing assembly 21 performs shearing of the trailing end 23*a* of the rolled product 111 of that coil 18*a* so as to make the trailing end 23*a* flat, parallel and free of scale and therefore suitable for flash welding, with laser technique or induction.

The strip emerging from the connection assembly according to a variant is subjected to descaling by a descaling assembly 13, then delivered to an assembly performing rolling of the edges before entering the finishing assembly 20.

The finishing assembly 20 includes a desired number of finishing stands which, according to a variant, include between two finishing stands, or between all the finishing stands, means 40 to monitor the temperature of the strip and means 41 to cool the strip. These means 41 to cool the strip are controlled by a data processing unit connected to the means 40 to monitor the temperature of the strip.

Descaling means 13 are included, according to a variant, in cooperation with the shears 21 and downstream thereof and act on the leading end of the now rough-formed product and remove any scale or other impurities thereon.

According to a variant the shearing assembly 21 is arranged within a substantially closed chamber 34 having an atmosphere saturated with a neutral gas, argon for instance or another suitable gas, which prevents oxidation of the sheared end of the rough-formed product.

At the same time, a new coil 18 is unwound and is fed to the shearing assembly 21, which crops the leading end 23.

The shearing assembly 21 can be substantially of any type of the state of the art.

According to a variant the shearing assembly 21 includes generally a flying shears 22 comprising two opposed drums with one or two pairs of blades (shown only diagrammatically in FIGS. 2 and 3); this flying shears 22 performs in succession the shearing of the trailing end 23*a* of the previous coil 18*a* and the shearing of the leading end 23 of the new coil 18.

The structure of the flying shears 22 is normally secured to the ground and the shearing is carried out by making use of the kinetic energy accumulated in the rotation of the drums.

Figure 3:
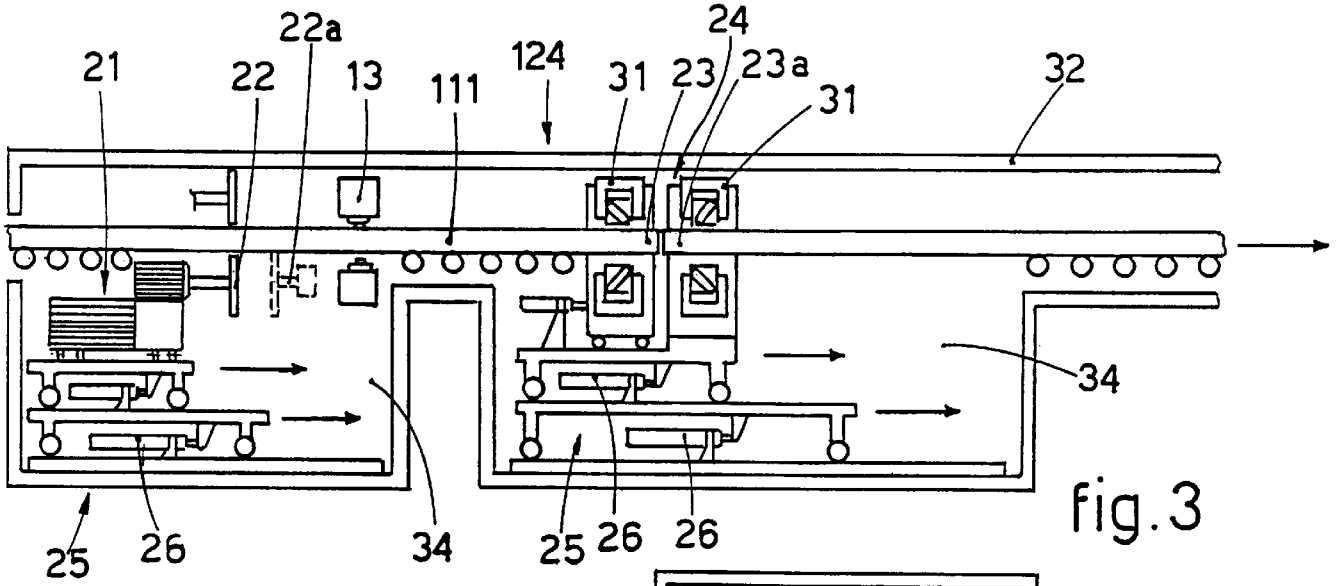
FIG. 3 shows a possible accompanying flash welding unit according to the invention.

According to a variant two flying shears 22, 22*a*, shown with lines of dashes in FIG. 3, are included in adjacent positions and are offset in relation to the direction of movement of the rolled product 111 being unwound from the respective coil 18, each of the flying shears 22, 22*a* cooperating with its respective coil 18.

According to another variant, the shearing of the leading end and the trailing end is performed by a shears with rotary disks, of the accompanying type.

The ends thus pre-arranged of the two coils 18 and 18*a* respectively are then caused to cooperate with a welding machine 24, which performs the welding of the leading end 23 to the trailing end 23*a*, thus achieving continuity of the product to be rolled.

The welding machine 24 can be of the induction type or laser type, but preferably the flash-welding type.

FIG. 3 shows an example of a welding machine 24 of an accompanying type, in which jaws 31 are positioned on movable means 25 governed by relative actuator means 26.

The jaws 31 act as welding electrodes and as elements to support and draw together the ends to be welded, thus bringing those ends into reciprocal contact and exerting therebetween an adequate pressure during the welding step.

The speed of the movable means 25 is regulated by a control unit according to the speed of feed of the rough-formed product 111 to be welded.

In this case, the flying shears 22 is of an accompanying type and is supported and moved by relative movable means 25.

Figure 4:
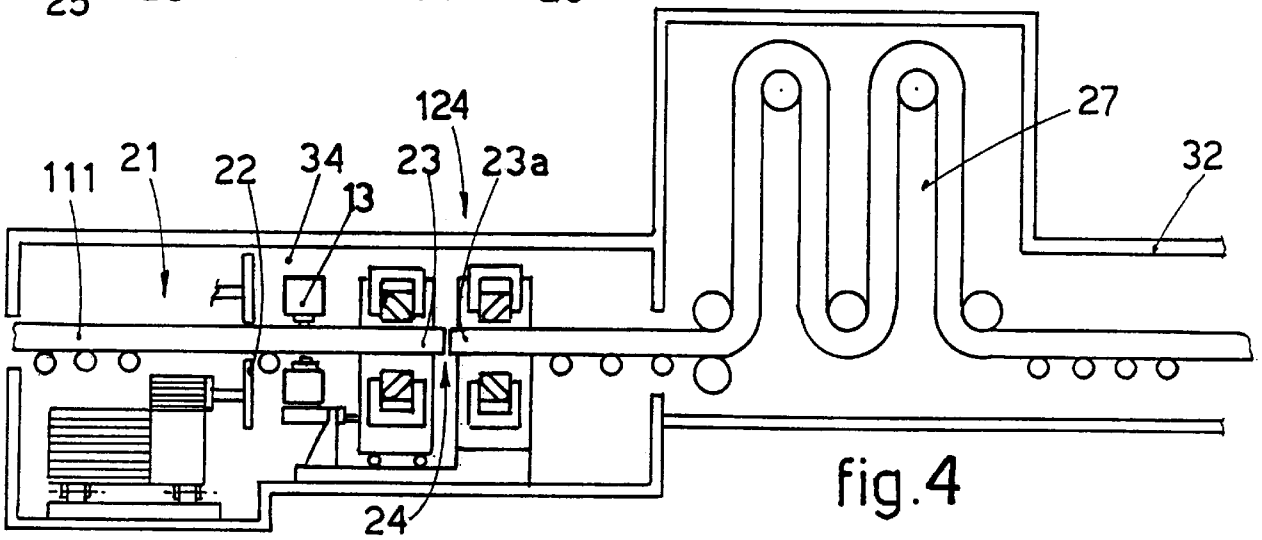
FIG. 4 shows a possible static flash welding unit according to the invention.

FIG. 4 shows a variant in which the welding machine 24 is of a static type.

In this case, so as to enable the finishing train 20 positioned downstream to be continuously fed, while the shearing assembly 21 and the welding machine 24 are fed step by step, a loop-forming system 27 having the function of a buffer stock is included between the welding machine 24 and the finishing train 20.

During the feed of the rough-formed product 111 being unwound from the respective coil 18 and arriving from the welding machine 24, the loop-forming system 27 accumulates the rough-formed product 111 which is thereafter released during the shearing and welding dwell periods.

The welding machine 24, the shearing assembly 21 and the loop-forming system 27 are located in an insulated environment equipped with a cover 32 permitting access so as to prevent cooling of the rough-formed product 111.

The rough-formed product 111 is then subjected to descaling by descaling means 13, which carry out cleaning of the surface of the product 111, which then passes to the finishing train 20, which reduces the thickness of the product to a value between 0.8 mm and 8 mm. to 12.5 mm; downstream of the finishing train 20 there is at least a shears assembly 29.

The plate or strip thus produced is cooled thereafter on a removal roller conveyor 28, is sheared in the vicinity of the weld by flying shears 29 and is wound in coils by a winding assembly 30 so as to be forwarded to the successive steps of strapping, weighing, marking, etc.

We claim:

1. A method for the continuous rolling of product, comprising:

continuously casting pre-slabs in at least two continuous casting lines within a range of thickness of between 70 and 140 mm at a speed of 6–7 meters per minute;

reducing the thickness of the pre-slabs by 5–40 mm by a process of soft-reduction to obtain thin slabs with a thickness of between 60 and 120 mm;

heating the thin slabs;

rolling the thin slabs from the at least two continuous casting lines in a roughing train;

winding the rolled product into a coil;

finishing the rolled product from the roughing train in a finishing train to form a product having a value of speed of the product leaving the finishing train, measured in m/min, multiplied by thickness of the product, measured in m/min, of between 800 and 1100 mm.ml/min; and welding a leading end of the rolled product arriving at the finishing train with a trailing end of the product in the finishing train by means of a welding machine positioned upstream of the finishing train to form a substantially continuous product fed to the finishing train.

2. Method as in claim 1, in which the process of soft-reduction reduces the thickness of the pre-slab within a range of between 10 and 30 mm.

3. Method as in claim 1, further comprising immediately winding the rolled product leaving the roughing train into a coil and feeding the rolled product from the coil to the finishing train.

4. Method as in claim 1, in which the welding step is carried out in an environment suitable to prevent oxidation of the ends of the coils (18–18*a*) to be welded.

5. Method as in claim 1, in which at least one stand of the roughing train includes means to continuously control the planar condition of the emerging rolled product, associated with means to condition the pre-load of the roughing rolls.

6. Method as in claim 1, in which at least a temperature of the rolled product is controlled in the finishing train, and that this control governs and conditions means to cool the rolled product so as to maintain a final rolling temperature at between 840 and 880° C.

7. Method as in claim 1, in which the product emerging from the soft-reduction assembly is subjected to a heating step with an induction furnace followed by descaling by means of a descaling assembly and then heating by means of a heating furnace.

8. Method as in claim 1, in which the heating of the product is conducted in a heating furnace, and the product is displaced sideways in the heating furnace.

9. Method as in claim 1, in which the heating is conducted in a heating furnace, and the slab is subjected to a descaling action by means of a descaling assembly at the outlet of the heating furnace and to the action of an assembly performing the rolling of the edges of the slabs.

10. Method as in claim 1, in which after rolling in the roughing train, the rolled product is subjected to descaling by a descaling assembly and then wound into coils.

11. Method as in claim 1, in which after the leading end and trailing end have been welded, and before entering the finishing train, the rolled product is subjected to the action of a descaling assembly and to the action of an assembly to roll the edges.

12. Method as in claim 1, in which, before the welding step, the trailing end of the coil being rolled is sheared, and the leading end of the coil which is still to be rolled is sheared, and a step of descaling of the cropped ends of the coils to be welded is included between the cropping step and the welding step, the cropping, descaling and welding steps all being performed in a substantially closed chamber containing an atmosphere saturated with a neutral gas.

13. Method as in claim 1, in which each continuous line is equipped with at least a standard crystalliser which produces a pre-slab which is compatible with the range of thicknesses of the typical slabs for the rolling plant.

14. Method as in claim 1, in which at the outlet of the roughing assembly the rolled product is between 15 and 40 mm thick, the thickness being coherent with that of the final product and with the rolling cycle which will be applied thereto.

15. Method as in claim 1, in which the welding of the leading and trailing ends is carried out while the leading and trailing ends are travelling by means of welding by a welding machine accompanying the leading and trailing ends.

16. Method as in claim 1, in which the welding of the leading and trailing ends is carried out in the halted position by means of static welding.

17. Method as in claim 1, in which the product leaving the finishing train has an end-of-rolling temperature between 840 and 880° C.

18. A line for the continuous rolling of product, comprising:

at least two continuous casting lines for casting pre-slabs, each of the at least two continuous casting lines comprising a crystallizer and a soft reduction assembly for reducing a thickness of the pre-slabs by 5 to 40 mm;

a roughing train downstream of and associated with each of the at least two continuous casting lines, the roughing train being fed with slabs between 60 and 120 mm thick;

a finishing train downstream of the roughing train; and a welding machine provided between the roughing train and finishing train for welding a leading end of product arriving at the finishing train to a trailing end of product being rolled in the finishing train.

19. Continuous rolling line as in claim 18, further comprising a winding/unwinding assembly downstream of the roughing train there is a winding/unwinding assembly.

20. Continuous rolling line as in claim 19, further comprising a descaling unit immediately upstream of the winding/unwinding assembly.

21. Continuous rolling line as in claim 18, in which the soft-reduction assembly is able to reduce the thickness of the strip by 10 to 30 mm.

22. Continuous rolling line as in claim 18, in which at least one stand of the roughing train is equipped with means to control the planar condition of the strip, associated with means to preload roughing rolls of the roughing train.

23. Continuous rolling line as in claim 18, in which the finishing train includes at least means to control a final rolling temperature.

24. Continuous rolling line as in claim 18, in which the means to control the rolling temperature govern means to cool the rolling product.

25. Continuous rolling line as in claim 18, in which each casting line includes in order after the soft-reduction assembly a shears, an induction furnace, a descaling assembly, and a heating furnace.

26. Continuous rolling line as in claim 18, in which each casting line includes in order after the soft-reduction assembly a descaling assembly, a shears, and a heating furnace.

27. Continuous rolling line as in claim 18, in which each casting line includes a heating furnace having an inlet roller conveyor and means to transfer the pre-slabs sideways inside the heating furnace.

28. Continuous rolling line as in claim 18, in which each casting line comprises a heating furnace, and the line further comprises, upstream of the roughing train and downstream of the heating furnace, a descaling unit and at least an assembly to perform rolling of the edges of the slabs.

29. Continuous rolling line as in claim 18, further comprising, downstream of the welding machine and upstream of the finishing assembly, a descaling unit and at least an assembly to perform rolling of the edges of the slab.

30. Continuous rolling line as in claim 18, further comprising shearing means for cropping of a segment of the trailing end of the product being rolled in the finishing train and of a segment of the leading end of the product to be rolled in the finishing train, the shearing means being included upstream of the welding machine.

31. Continuous rolling line as in claim 30, further comprising a descaling unit for descaling the sheared ends of the product included downstream of the shearing means.

32. Continuous rolling line as in claim 31, in which the shearing means, the descaling and the welding machine are located within a substantially closed chamber which contains an atmosphere saturated with a neutral gas.

33. Continuous rolling line as in claim 30, in which the shearing means are positioned on the welding machine.

34. Continuous rolling line as in claim 30, further comprising means for moving the shearing means downstream to accompany the leading and trailing ends.

35. Continuous rolling line as in claim 30, in which the shearing means are of a static type.

36. Continuous rolling line as in claim 30, in which the shearing means cooperating in succession with the trailing end of the product being rolled and with the leading end product to be rolled in the finishing train.

37. Continuous rolling line as in claim 30, in which the shearing means comprise at least two flying shears governed by respective motors and axially offset from each other in the direction of feed of the rolled product.

38. Continuous rolling line as in claim 18, in which the welding machine is of a static type and cooperates downstream with a loop-forming means.

* * * * *